United States Patent [19]

Würmli

[11] 4,338,775

[45] Jul. 13, 1982

[54] INNER RING FOR SPINNING RING

[75] Inventor: Arthur Würmli, Winterthur, Switzerland

[73] Assignee: Rieter Machine Works Limited, Winterthur, Switzerland

[21] Appl. No.: 193,945

[22] PCT Filed: Oct. 17, 1979

[86] PCT No.: PCT/EP79/00079

§ 371 Date: Jul. 6, 1980

§ 102(e) Date: Jun. 20, 1980

[87] PCT Pub. No.: WO80/00982

PCT Pub. Date: May 15, 1980

[30] Foreign Application Priority Data

Nov. 6, 1978 [CH] Switzerland ..... 11394/78

[51] Int. Cl.³ ..... D01H 7/54

[52] U.S. Cl. ..... 57/119; 57/122

[58] Field of Search ..... 57/119, 121, 122, 124

[56] References Cited

U.S. PATENT DOCUMENTS

| | | | |
|---|---|---|---|
| 733,495 | 7/1903 | Lovejoy | 57/124 |
| 1,689,129 | 10/1928 | Gilligan | 57/121 |
| 1,861,249 | 5/1932 | Stuart | 57/121 |
| 2,464,150 | 3/1949 | Roatta et al. | 57/121 |
| 2,464,151 | 3/1949 | Roatta et al. | 57/121 |
| 3,374,616 | 3/1968 | Hidden et al. | 57/119 |

*Primary Examiner*—Donald Watkins

*Attorney, Agent, or Firm*—Werner W. Kleeman

[57] ABSTRACT

Operatively connected with a spinning ring of a ring spinning or ring twisting machine is a tubular inner ring at a small distance, the upper limit or boundary of such inner ring being located at a higher position than the traveller guide surface defined on the spinning ring, in such a manner that unthreading of the thread, which no longer is tensioned by the traveller is rendered impossible. Also the inner ring and/or the spinning ring are provided with at least one slot-opening by means of which traveller debris can escape. Furthermore the distance of the outer upper edge of the inner ring from the traveller guide surface is to be chosen sufficiently large, so that upon restarting of the winding process the traveller does not collide with the inner ring.

10 Claims, 4 Drawing Figures

INNER RING FOR SPINNING RING

BACKGROUND OF THE INVENTION

The present invention concerns an inner ring on a spinning ring for ring spinning and ring twisting machines which is arranged coaxially inside the spinning ring, a gap-forming clearance being maintained, the upper traveller guide surface of which spinning ring is designed for taking up an inner traveller leg extending downward and outward.

Lubricated spinning rings for twisting machines with a concentrically arranged, tubular inner ring are already known from the Japanese Utility Publication Sho No. 43-13305/68 (comp. German DE-GM No. 71 40 330), in which arrangement the inner ring merely serves for preventing contamination of the bobbin packages by broken thread or yarn ends thrown about and soiled by dirty or greasy machine parts.

As the ring flange which takes up the circulating C-traveller, is located still too far away from the upper end of the inner ring, however, and as also the lower inner end of the traveller is located at about the same height as the upper edge of the inner ring, the inner ring cannot prevent unthreading of the thread or yarn downwardly along the inner leg of the traveller, if the thread or yarn tension is released, and especially if the thread forms loops during a stand-still of the spindle. Rethreading of the thread requires considerable operator effort and thus is extremely disadvantageous to an efficient and economic operation of a ring spinning or ring twisting machine.

Furthermore, these rings show the disadvantage that between the spinning ring and the inner ring a closed annular chamber is formed, in which traveller debris and fly waste can accumulate, and which thus require periodic cleaning. This disadvantage prevails also in a known, similar spinning ring according to U.S. Pat. No. 1,861,249.

Rings designed for non-unthreading travellers also are known (Japanese Utility Model No. 32263/74), which ring contains in the lower inner part of the flange guiding the traveller a groove, into which penetrates a traveller leg, bent intensely inwardly and ending upward. Furthermore a shoulder extending at an inclination downward and inward is provided on the inside of the ring, which shoulder serves as a traveller support surface while the spindle is at a standstill.

A disadvantage of this solution, however, is that no standard traveller readily available on the market can be applied, and that insertion and exchange of the special traveller proves difficult. Furthermore, a ring of this type does not ensure reliable prevention of the unthreading of the yarn or thread.

SUMMARY OF THE INVENTION

It thus is an object of the present invention to avoid the disadvantages of the rings and travellers mentioned, and to propose auxiliary means for a spinning ring, which reliably prevent unthreading even in case of loop formation, and permit use of a standard traveller and of normal rings adapted for such travellers, and in which no accumulation of traveller debris and fly waste can form between the ring and the inner ring.

This object is achieved by an inner ring constructed according to the invention, the upper end of which inner ring, for supporting the untensioned thread, is located at a higher position than the lower limit of the guide surface for the traveller leg on the unlubricated spinning ring.

The upper, outer edge of the inner ring in this arrangement is to be located with respect to the guide surface of the traveller at such a distance that the traveller is started up without contacting the inner ring.

This proves advantageous as the traveller is not influenced by the inner ring in any manner even during the phase of its start-up, in such manner that no additional thread or yarn breakages occur.

The inner ring can be mounted onto the spinning ring by a slide fit or by press fit, in such manner that the advantage of the choice of materials is obtained. The inner ring also can be glued to the spinning ring.

Particularly advantageous to manufacture is an inner ring which is part of a mounting body arranged on a ring rail of the machine for the spinning ring. An inner ring of this type can be manufactured economically using injection moulding processes and without considerable subsequent machining.

BRIEF DESCRIPTION OF THE DRAWINGS

The invention is described in more detail in the following with reference to illustrated design examples. It is shown in.

DETAILED DESCRIPTION OF THE PREFERRED EMBODIMENTS

Figure 1:
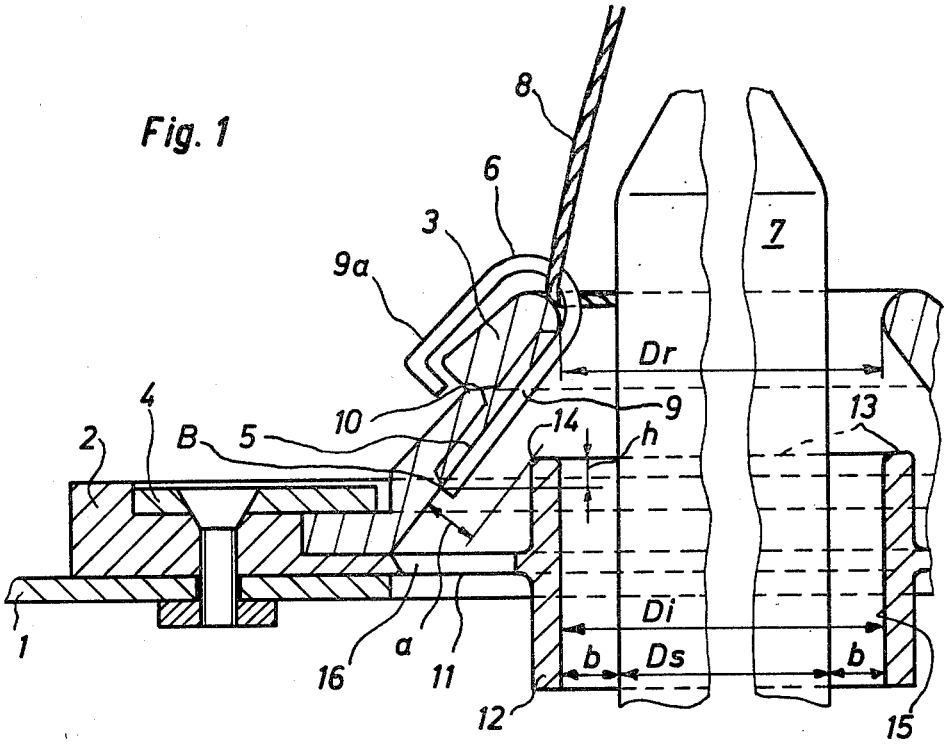
FIG. 1—a section along a plane containing the ring axis, with the traveller in its working position, FIG. 2—a detail of FIG. 1, with the traveller in its idle position, FIG. 3—a section of an inner ring with a ring flange adapted for C-travellers, FIG. 4—a section of an alternative design example of an inner ring.
Figure 2:
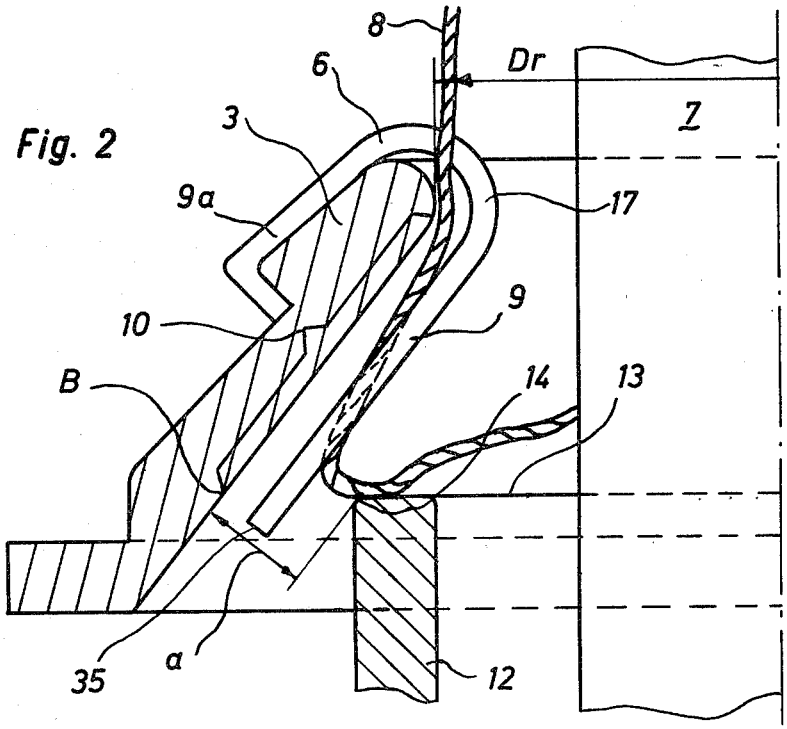

A ring rail 1 (FIG. 1) is equipped with a ring holder 2, into which an unlubricated spinning ring 3 is inserted and is clamped by clamping extensions 4 in a manner known as such (e.g. Swiss Patent CH-PS No. 458 152). The spinning ring 3 is provided with an upper inner surface 5, on which rotates an inserted traveller 6. The yarn or thread 8 to be taken up on the bobbin package 7 is supplied from above to the traveller 6 through which it passes, leaving it at the back in tangential direction with respect to the bobbin package surface, and owing to the action of the centrifugal forces the traveller 6 contacts the ring with its inner leg 9 extending downward and inward. The surface of the spinning ring 3 swept by the the traveller leg 9 is defined in this context as traveller guide surface 10. A tubular inner ring 12 supported concentrically by the bottom wall 11 of the ring holder 2 is arranged in such manner that its upper end or boundary 13 is located higher, by a vertical distance h, than the traveller guide surface 10 swept by the traveller leg 9 and having a lower limit B, and that its outer edge is located at merely such a distance a (FIG. 2) from the traveller guide surface 10, in such manner that the circulating traveller 6 in its various modes of operation has sufficient clearance in the gap. The dimension of this distance a (approximately 1 to 2.5 mm at an inside diameter Dr of the ring of 45 to 55 mm) is determined by the traveller 6, which during the start-up phase is pulled toward the inside while the centrifugal forces are not yet active, and the inside leg 9 of which also in this extreme position does not contact the inner ring 12. The tubular inner ring 12 extends downward to a location below the ring rail 1. Its inside surface 15 is cylindrical, and its inside diameter Di exceeds the maximum diameter Ds of the bobbin package by the amount b, which takes care of the unavoidable deviation of the bobbin due to out of round effects. At a bobbin package diameter Ds ranging from 45 to 55 mm this radial distance b ranges approximately between 1.5 and 2.5 mm. In this manner also the frequently noticed formation of beards, i.e. small fibre bundles sticking out of the bobbin packages, is suppressed or reduced, respectively, which beard formation lends a rough and improper appearance to the bobbin package. The diameter Dr is about the same as the diameter Di.

In the spinning ring 19 (FIG. 3) one or a plurality of slots 23 extending in circumferential direction can be provided which permit debris of broken travellers to be thrown out. In this arrangement the position of the slots 23 advantageously is chosen such that the lower surface 24 of the slot 23 and the upper surface 25 of foot 21 are located at the same height.

In advantageous manner the ring holder 1 (FIG. 1) including the inner ring 12 is formed as one injection moulded piece. The openings 16, evenly spaced along the circumference in the bottom wall 11 for saving material, in advantageous manner also serve as ejection openings for traveller debris of the inside traveller leg 9 thrown down after a traveller breakage, as the breakage occurs at the highly stressed arch or curved portion 17 (FIG. 2) of the traveller 6, and as the outer leg 9*a* only is thrown off freely.

Figure 3:
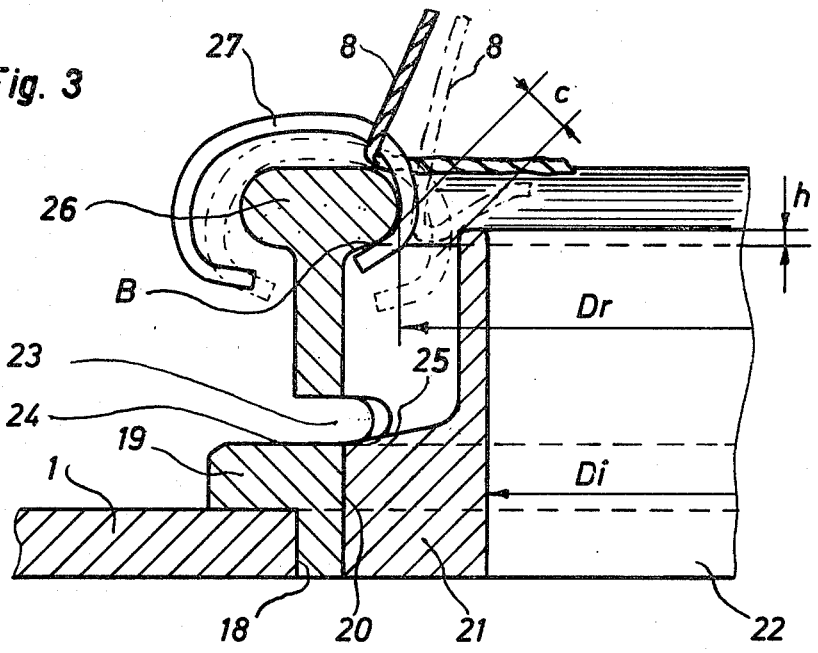

In FIG. 3 an alternative design embodiment shows a spinning ring 19 mounted into a bore 18 of the ring rail 1. Set into its lower inside surface 20 is an inner ring 22 provided with a reinforcing foot ring 21 which can be press fitted or glued in. The spinning ring 19 is provided with a normal flange 26 for a C-traveller 27. The diameter Di necessarily is smaller than the diameter Dr, as the inner ring 22 extends upward to between the traveller 27 and the bobbin package 7. For the distance c the conditions mentioned above for the distance a are required. The idling position of the traveller 27 is indicated with dash-dotted lines.

Figure 4:
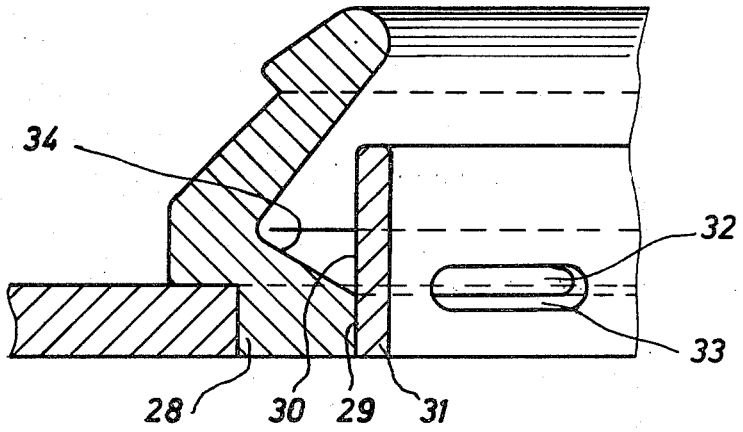

In the alternative embodiment according to FIG. 4 the spinning ring 28 is provided with a cylindrical inside surface 29, which together with the outer surface of the inner ring 31 to be taken up forms a slide fit, in such manner that the inner ring 31 can be taken off easily for cleaning purpose. Instead of a slide fit also a press fit can be provided. The detachable inside or inner ring 31 can be made from plastic material or of another material which is less expensive than the material of the wear-resistant, i.e. higher quality material, of the spinning ring 28.

In the last mentioned alternative embodiment according to FIG. 4 one or a plurality of slots 32 extending in circumferential direction are provided in the inner ring 31, which also permit traveller debris to be thrown out, the lower surface 33 of the slot 32 merging into the conical surface 34 of the spinning ring 28.

The function and the action of the inventive inner ring now will be described and follows:

As the spindle drive is stopped, or as the spindle is braked, the spindle 7 comes to standstill within a short time. As the forces acting on the thread 8 during operation disappear (any possibly remaining residual tension being negligible), the thread 8 now drops under the influence of gravity, assisted by loop formation, along the traveller leg 9, which now no longer contacts the traveller guide surface 10, and reaches the position indicated in FIG. 2, in which the upper end 13 of the inner ring prevents any further descent of the thread, which thus cannot pass beneath the lower end 35 (FIG. 2) of the traveller leg 9. Unthreading of the thread 8 from the traveller 6 thus is practically excluded.

As the spindle is re-started, the above mentioned sequence is reversed; the thread is tensioned again and slides back to its operative position to the arch or curved portion 17 of the traveller 6.

Also in the re-starting phase unthreading thus is effectively suppressed. No time consuming re-threading work being required, spindle down-time periods are reduced and machine efficiency thus is increased considerably.

While there are shown and described present preferred embodiments of the invention, it is to be distinctly understood that the invention is not limited thereto, but may be otherwise variously embodied and practiced within the scope of the following claims.

What I claim is:

1. An inner ring arrangement for a spinning ring of ring spinning or ring twisting machines, comprising:

an inner ring arranged substantially coaxially within the spinning ring so as to maintain therebetween a gapforming clearance;

said spinning ring having an upper traveller guide surface structured for taking-up an inner traveller leg of a traveller, said inner traveller leg extending downwardly and outwardly;

said inner ring having an upper end serving to support an untensioned thread, said upper end of the inner ring being located at a higher position than a lower limit of the traveller guide surface for said traveller leg on the spinning ring; and at least one substantially slot-shaped opening extending in circumferential direction provided for one of said rings.

2. The inner ring arrangement as defined in claim 1, wherein:

said inner ring has an outer upper edge at the region of its upper end and which is located at a distance with respect to the traveller guide surface which enables start-up of the traveller without the traveller contacting the inner ring.

3. The inner ring arrangement as defined in claim 1, wherein:

said at least one slot-shaped opening is provided with a bottom surface merging into a surface limiting a bottom region of the clearance gap.

4. The inner ring arrangement as defined in claim 1, further including:

a wall limiting the clearance gap at a lower region thereof; and said wall being provided with openings.

5. The inner ring arrangement as defined in claim 1, wherein:

said inner ring is exchangeably mounted with a sliding fit in the spinning ring.

6. The inner ring arrangement as defined in claim 1, wherein:

said inner ring is mounted with a press fit in said spinning ring.

7. The inner ring arrangement as defined in claim 1, wherein:

said inner ring is adhesively bonded to said spinning ring.

8. The inner ring as defined in claim 1, further including:

a ring rail provided at the machine;

a mounting body for the spinning ring arranged on said ring rail; and said inner ring constituting part of said mounting body.

9. The inner ring arrangement as defined in claim 6, wherein:

a reinforcing bottom ring is provided on the outside of said inner ring.

10. The inner ring arrangement as defined in claim 7, wherein:

a reinforcing bottom ring is provided on the outside of said inner ring.

* * * * *